US010745890B2

(12) United States Patent
Cleophas et al.

(10) Patent No.: US 10,745,890 B2
(45) Date of Patent: Aug. 18, 2020

(54) ADAPTER SYSTEM FOR CUTTING TOOTH

(71) Applicant: IHC Holland IE B.V., Sliedrecht (NL)

(72) Inventors: Eugenius Petrus Elisabeth Marie Cleophas, Rotterdam (NL); Roelof Breken, Gorinchem (NL)

(73) Assignee: IHC Holland IE B.V., Sliedrecht (NL)

( * ) Notice: Subject to any disclaimer, the term of this patent is extended or adjusted under 35 U.S.C. 154(b) by 0 days.

(21) Appl. No.: 15/774,597

(22) PCT Filed: Nov. 11, 2016

(86) PCT No.: PCT/NL2016/050785

§ 371 (c)(1),
(2) Date: May 9, 2018

(87) PCT Pub. No.: WO2017/082729

PCT Pub. Date: May 18, 2017

(65) Prior Publication Data

US 2018/0328004 A1 Nov. 15, 2018

(30) Foreign Application Priority Data

Nov. 13, 2015 (NL) ..... 2015785

(51) Int. Cl.
*E02F 9/28* (2006.01)

(52) U.S. Cl.
CPC ..... *E02F 9/2825* (2013.01); *E02F 9/2816* (2013.01); *E02F 9/2858* (2013.01); *E02F 9/2866* (2013.01)

(58) Field of Classification Search
CPC ..... E02F 9/2825; E02F 9/2816; E02F 9/2858; E02F 9/2866
See application file for complete search history.

(56) References Cited

U.S. PATENT DOCUMENTS 2,452,081 A * 10/1948 Sullinger ..... E21C 35/193 175/383
4,349,232 A * 9/1982 Braun ..... E21C 35/18 299/109

(Continued)

FOREIGN PATENT DOCUMENTS

EP 1997967 A1 12/2008
WO 2005/005737 A1 1/2005

(Continued)

OTHER PUBLICATIONS

Bosta Selection Chart.

*Primary Examiner* — Jamie L McGowan
(74) *Attorney, Agent, or Firm* — N.V. Nederlandsch Octrooibureau; Catherine A. Schultz; Katelyn J. Bernier

(57) ABSTRACT

A tooth system for a cutter head includes a tooth member comprising a cutting portion and a mounting portion with at least one curved surface, a holder comprising a receiving portion with a curved surface complementary to the at least one curved surface of the tooth member, the receiving portion for receiving the mounting portion of the tooth member. The mounting portion of the tooth member detachably engages the holder such that when engaged, the at least one curved surface of the tooth member and the receiving portion curved surface contact each other at a contact area.

13 Claims, 2 Drawing Sheets

(56) References Cited

U.S. PATENT DOCUMENTS

| | | | | | |
|---|---|---|---|---|---|
| 4,609,227 | A * | 9/1986 | Wild | E21C 35/18 | 299/103 |
| 4,762,372 | A * | 8/1988 | Rassmann | E21C 35/19 | 299/108 |
| 4,828,327 | A * | 5/1989 | Wechner | E21C 35/193 | 299/102 |
| 4,932,145 | A * | 6/1990 | Reeves, Jr. | E02F 9/2825 | 37/451 |
| 5,092,660 | A * | 3/1992 | Steinkuhl | E21C 35/19 | 299/103 |
| 7,547,075 | B2 * | 6/2009 | Tewes | E21C 35/19 | 299/106 |
| 7,694,443 | B2 * | 4/2010 | Gabela | E02F 9/2825 | 299/102 |
| 9,988,904 | B2 * | 6/2018 | Siepenkort | E21C 35/1936 | |
| 10,294,787 | B2 * | 5/2019 | Zaayman | E21C 35/1936 | |

FOREIGN PATENT DOCUMENTS

| | | | |
|---|---|---|---|
| WO | 2010/079108 | A1 | 7/2010 |
| WO | 2011/149344 | A1 | 12/2011 |
| WO | 2012/006664 | A1 | 1/2012 |

* cited by examiner

ADAPTER SYSTEM FOR CUTTING TOOTH

BACKGROUND

The present invention relates to a tooth system for a cutter head, in particular to a tooth system for dredging cutter head.

From WO 2005/005737 A1 a tooth system is known for a tool for earth moving machinery. The tooth system is of the type comprising a holder located on the tool and a front tooth portion that is detachably arranged on and in relation to the holder. The tooth portion is in the form of an exchangeable wear and/or replacement part intended for the actual earth moving. The tooth portion has a rear leg and the holder has a cavity designed to receive the leg in interaction with the tooth portion and thereby achieve a unified joint for assimilation of occurring loads.

WO 2005/005737 A has for its purpose to achieve a new and improved tooth system for the tool for an earth removal machine. The tooth system essentially reduces or wholly eliminates the wear between the different connection parts caused by hammering and/or caused by too large surface loads on the tooth system's joint between the holder and tooth point.

WO 2005/005737 A therefore proposes a tooth system distinguished by the tooth leg and holder cavity, along at least a front part of said joint, to have a multi-armed, preferably cruciform, cross section comprising at least four projection arms and at least four grooves each that interact with each projecting arm, respectively, which projection arms comprise an, essentially vertically arranged, upper arm, an, essentially vertically arranged, lower heel and two, essentially horizontally and laterally arranged, wing portions, wherein a tensioning device is arranged at the rear part of the cavity in order to achieve adjustable pretensioning that tightens the tooth portion in relation to the holder, essentially axially along the axial symmetry axis Y of the cavity.

U.S. Pat. No. 4,932,145 A relates to a tooth point and adapter assembly for a bucket. In case of a bucket the line of action of a cutting force is more predictable than compared with a dredging head. The tooth point has an enclosed cavity for receiving the adapter mounting portion. The adapter has no cavity for receiving a mounting portion of the tooth member. As a disadvantage, the cavity being part of the tooth makes the tooth less massive and less robust and transfer of forces is at a relative small circumference. The tooth point needs to be locked against rotation opposite to that traveled during installation. This is also a disadvantage of this known tooth point and adapter assembly. To fully secure the tooth point onto the adapter, the tooth and adapter are bolted together.

US 2007/241605 A1 relates to a device for securing a shank chisel. The device has a chisel holder that has a chisel receiver for the shank chisel. The device has no cavity for "receiving the mounting portion of the tooth member". The receiver is formed in the tooth member.

U.S. Pat. No. 4,761,900 A relates to an excavating tooth comprising an adapter and a point. As far as understood, the point is twisted onto the adapter through application of helical thread. This makes this adapter and tooth system complicate and rather vulnerable in harsh and polluting environments, like a dredging operation.

There is a need for improvement of known tooth systems in that the joint between the holder and tooth portion is even more firmly fixed.

SUMMARY OF THE INVENTION

The invention aims to provide a tooth system for a cutter head wherein a holder and a tooth member are more fixedly joint such that loss of teeth is prevented.

Another object of the invention is to improve known tooth system for a cutter head in that a problem associated therewith is at least partly solved.

Yet another object of the invention is to provide an alternative tooth system for a cutter head.

According to a first aspect of the invention this is realized with a tooth system for a cutter head, the tooth system comprising;

- a tooth member comprising a cutting portion and a mounting portion with at least one curved surface,
- a holder comprising a receiving portion with a curved surface complementary to the at least one curved surface of the tooth member, the receiving portion for receiving the mounting portion of the tooth member, wherein the mounting portion of the tooth member detachably engages the holder such that when engaged, the at least one curved surface of the tooth member and the receiving portion curved surface contact each other at a contact area, and wherein the at least one curved surface of the tooth member and the receiving portion curved surface are configured such that the tooth member rotates upon engaging of the tooth member with the holder.

Because of the curved surface of the at least one curved surface of the tooth member and the receiving portion curved surface, the contact area between the holder and the tooth member is increased which in turn results in a more fixedly joint between the holder and the tooth member that is more suitable for the absorption of arising forces during cutting. Because of the increased contact area between the holder and the tooth member, contact forces between the tooth member and the holder are more widely spread because of this increased contact area, and subsequently less wearing problems will occur.

In addition, the curved shape of the curved surface of the at least one curved surface of the tooth member and the receiving portion curved surface provides a more entwined connection between the holder and the tooth member. This all the more increases the resistance against loss of teeth and improves the absorption of arising forces during cutting. The curved shape of the tooth member also increases the strength of the tooth member itself which makes it better to withstand cutting forces, and in turn will not break off easily.

The tooth system according to the invention is particularly useful for a dredge cutter head but however may also find a use in cutting systems for mining, trenching, earth moving in general, tunneling, excavating etc. on for example trenchers, cutter heads, drag heads, excavators, backhoes, mining machines, tunneling machines, cutter wheels, etc.

In an embodiment of the tooth system, the contact area comprises a single-curved portion. This facilitates the insertion of the mounting portion of the tooth member into the receiving portion of the holder.

In an embodiment of the tooth system, the mounting portion has a longitudinal axis, and the contact area has an axis of curvature that extends perpendicular with respect the longitudinal axis. This optimizes resistance against loss of teeth.

In an embodiment of the tooth system, the contact area has a radius r, the tooth member having a length l, wherein the ratio r/l is between 3 and 7. As a specific example, the ratio r/l is 5.

In an embodiment of the tooth system, the contact area comprises opposite curved surfaces having an identical or near identical radius r. Both the holder and the tooth member are provided with opposite curved surfaces. These surfaces contact to form the contact area that in this case extends in two parallel curved planes.

In an embodiment of the tooth system, the cutting portion extends transverse with respect to the longitudinal axis of the tooth member.

In an embodiment of the tooth system, the receiving portion of the holder comprises a cavity. The cavity being part of the the receiving portion of the holder makes the tooth more massive and more robust and transfer of forces is at a relative large circumference. The cavity surrounds the mounting portion of the tooth and supports the tooth such that any movement or rotation of the tooth is prevented. These advantages are all the more important in the field of dredging where loads are high and line of action of forces are less predictable. In particular, the cavity has a T-shaped cross section.

In an embodiment of the tooth system, the holder is undivided. This increases strength and dimensional accuracy.

In an embodiment, the tooth system comprises stops for defining a mounting position of the tooth member with respect to the holder.

The invention further relates to a cutter head comprising a tooth system according to the invention.

The invention further relates to a holder or tooth clearly intended for a tooth system according to the invention.

The invention further relates to a tooth member for a cutter head tooth system, the tooth member comprising a mounting portion with a curved surface detachably connectable to a holder with a complementary curved surface in a receiving portion. The tooth member is in particular suitable for a tooth system according to the current invention.

The invention further relates to a method of connecting a tooth to a holder of a tooth system for a cutter head, the method comprising;

engaging a tooth mounting portion with a curved surface to a holder receiving portion with a complementary curved surface to secure the tooth to the holder; and, using the tooth as part of a cutter head operation.

In an embodiment of the method, the engaging a tooth mounting portion to a holder receiving portion comprises slidably engaging with a rotating movement.

The invention further relates to a device comprising one or more of the characterising features described in the description and/or shown in the attached drawings.

The invention further relates to a method comprising one or more of the characterising features described in the description and/or shown in the attached drawings.

The various aspects discussed in this patent can be combined in order to provide additional advantageous advantages.

DESCRIPTION OF THE DRAWINGS

The invention will be further elucidated referring to a prior art tooth system and an embodiment shown in the schematic drawings wherein shown in.

DETAILED DESCRIPTION OF EMBODIMENTS

Figure 1:
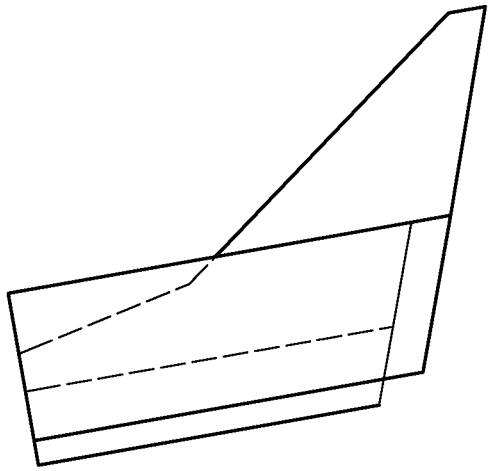
Fig. 1 Prior art.
FIG. 1 in side view a prior art tooth system.

FIG. 1 shows in side view a prior art tooth system. A tooth member is held in a holder. The tooth only translates in the holder towards its mounting position. The tooth is shown in its mounting position.

Figure 2:
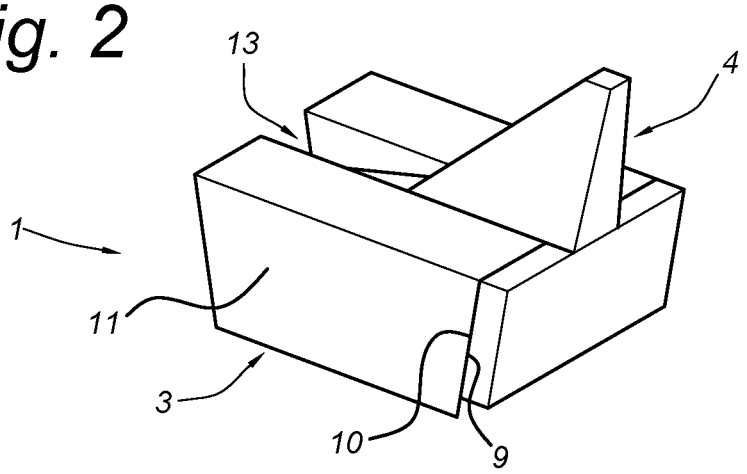
FIG. 2 a perspective view of a tooth system according to the invention.
Figure 3:
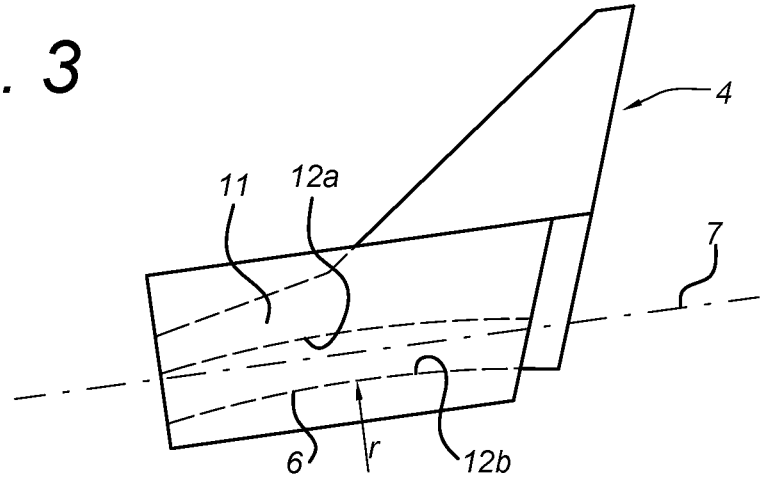
FIG. 3 a side view of the tooth system of FIG. 2.

FIGS. 2 and 3 show a tooth system 1 according to the invention for use on a cutter head (not shown).

The tooth system 1 comprises a tooth member 2. The tooth member 2 comprises a cutting portion 4 that engages the ground during cutting operations. The cutting portion 4 faces away from the cutter head. Here, the cutting portion 4 extends transverse with respect to a longitudinal axis 7 of the tooth member 2.

The tooth member 2 comprises a mounting portion 5. During use of the tooth system 1, the mounting portion 5 faces towards the cutter head.

The tooth system 1 comprises a holder 3 for connecting the tooth member 2 to the cutter head. Therefore the holder 3 comprises a receiving portion 11. The receiving portion 11 is configured for receiving the mounting portion 5 of the tooth member 2. The holder 3 itself is mounted with the cutting head in any suitable manner like e.g. by welding. In this case, the holder 3 is undivided.

The mounting portion 5 of the tooth member 2 has at least one curved surface 6. The mounting portion 5 of the tooth member 2 has a longitudinal axis 7. The curved surface 6 of the mounting portion 5 has an axis of curvature that extends perpendicular with respect to the longitudinal axis 7. Here, the curved surface 6 has a radius r. The tooth member 2 has a length l of for example 30 cm. The ratio r/l is between 3 and 7.

Figure 4:
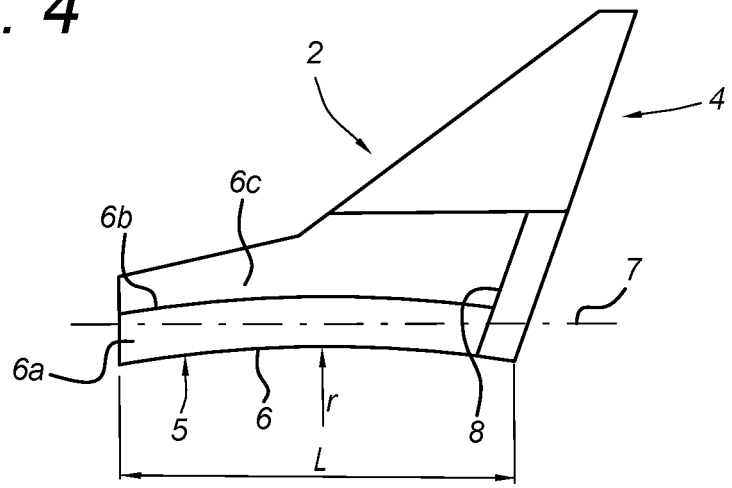
FIG. 4 a side view of a tooth member of a tooth system of FIG. 2.

As is shown in FIG. 4, the length l of the tooth member mounting portion 5 is defined as the chord between the ends of the curved surface 6.

The receiving portion 11 has a curved surface 12*b*. The receiving portion curved surface 12*b* is complementary to the at least one curved surface 6 of the tooth member 2.

The mounting portion 5 of the tooth member 2 detachably engages the holder 3. When the mounting portion 5 of the tooth member 2 engages the holder 3, the at least one curved surface 6 of the tooth member 2 and the receiving portion curved surface 12*b* contact each other at a contact area. In other words the curved surface 6 of the tooth member 2 and the receiving portion curved surface 12*b* contact along an area that is referred to as contact area. Said in another way, when the tooth member 2 is in its mounting position as shown in FIGS. 2 and 3, the overlap between the curved surface 6 of the tooth member 2 and the receiving portion curved surface 12*b*, determines the contact area. Here, the contact area is a single curved area.

The holder 3 has two complementary curved surfaces 12*a*, 12*b* in a receiving portion 11. The two complementary curved surfaces 12*a*, 12*b*, in other words opposite curved surfaces 12*a*, 12*b*, have identical or nearly identical radii r. The two complementary curved surfaces 12*a*, 12*b*, extend parallel with respect to each other.

The at least one curved surface 6 of the tooth member 2 and the receiving portion curved surface 6 are configured such that the tooth member 2 rotates upon engaging of the tooth member 2 with the holder 3.

The tooth system 1 has stops 9, 10 for defining the mounting position of the tooth member 2 with respect to the holder 3.

Figure 5:
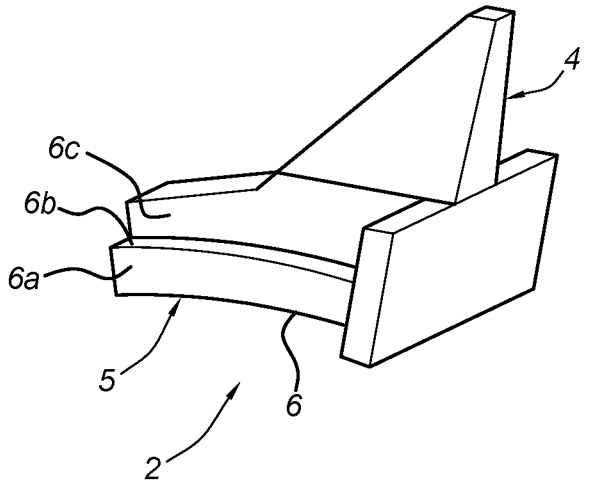
FIG. 5 a perspective view of a tooth member of FIG. 4.

FIGS. 4 and 5 show a tooth member 2 for a cutter head tooth system 1 of FIGS. 2 and 3. The mounting portion 5 has two curved surfaces 6 and 6*b*. The two curved surfaces 6 and 6*b* extend opposite. The two curved surfaces 6 and 6*b* extend parallel. The two curved surfaces 6 and 6*b* make up a curved flange. The curved flange extends along the longitudinal axis 7 and has an axis of curvature transverse with respect to the longitudinal axis 7. The mounting portion 5 has additional contact surfaces 6*a* and 6*c* that extend transverse with respect to the curves surfaces 6 and 6*b*.

The mounting portion 5 of the tooth member 2 has two complementary curved surfaces 6*a*, 6*b*. The two complementary curved surfaces 6*a*, 6*b*, in other words opposite curved surfaces 6*a*, 6*b*, have identical or nearly identical radii r. The two complementary curved surfaces 6*a*, 6*b*, extend parallel with respect to each other.

The mounting portion 5 has a T-shaped cross section. As shown best in FIG. 2, the receiving portion 11 of the holder 3 comprises a cavity 13 with a complementary T-shaped cross section.

When the tooth member 2 is in its mounting position, the contact surfaces 6, 6*a*, 6*b* and 6*c* engage the holder 3 in order to fixedly connect the tooth member 2 to the cutting head. The tooth member 2 is detachably connectable to the holder 3.

During connecting a tooth member 2 to a holder 3 of a tooth system 1 for a cutter head, the method comprising;

engaging a tooth mounting portion 5 with a curved surface 6 to a holder 3 receiving portion with a complementary curved surface to secure the tooth member 2 to the holder 3; and, using the tooth system 1 as part of a cutter head operation.

As an option, the engaging a tooth mounting portion 5 to a holder receiving portion comprises slidably engaging with a rotating movement.

It will also be obvious after the above description and drawings are included to illustrate some embodiments of the invention, and not to limit the scope of protection. Starting from this disclosure, many more embodiments will be evident to a skilled person which are within the scope of protection and the essence of this invention and which are obvious combinations of prior art techniques and the disclosure of this patent.

The invention claimed is:

1. A tooth system for a cutter head, the tooth system comprising;

a tooth member comprising a cutting portion and a mounting portion with at least one curved surface, a holder comprising a receiving portion comprising a cavity with an opening at a front of the holder and extending longitudinally in the holder, the cavity with a curved surface complementary to the at least one curved surface of the tooth member, the cavity of the receiving portion for receiving the mounting portion of the tooth member through the opening and in a sliding rotational movement into and through the cavity for engagement of the tooth member with the holder, wherein the mounting portion of the tooth member detachably engages the holder such that when engaged, the at least one curved surface of the tooth member and the receiving portion curved surface contact each other at a contact area, the contact area comprising opposite curved surfaces which are parallel to each other, and wherein the cavity surrounds the mounting portion of the tooth and supports the tooth member such that any movement or rotation of the tooth member other than a movement for disengagement of the tooth member is prevented when engaged.

2. The tooth system according to claim 1, wherein the contact area comprises a single-curved portion.

3. The tooth system according to claim 2, wherein the mounting portion has a longitudinal axis and the contact area has an axis of curvature that extends perpendicular with respect to the longitudinal axis.

4. The tooth system according to claim 1, wherein the contact area has a radius r, the tooth member having a length l, wherein a ratio r/l is between 3 and 7.

5. The tooth system according to claim 4, wherein a ratio r/l is about 5.

6. The tooth system according to claim 1, wherein the opposite curved surfaces of the contact area have an identical or nearly identical radius r.

7. The tooth system according to claim 1, wherein the cutting portion extends transverse with respect to a longitudinal axis of the tooth member.

8. The tooth system according to claim 1, wherein the cavity has a T-shaped cross section.

9. The tooth system according to claim 1, wherein the holder is undivided.

10. The tooth system according to claim 1, comprising stops for defining a mounting position of the tooth member with respect to the holder.

11. A cutter head comprising a tooth system according to claim 1.

12. A tooth member for a cutter head tooth system, the tooth member comprising a mounting portion with a curved lower surface extending the length of the tooth member in the longitudinal direction of the tooth member, and a cutting portion extending transverse with respect to the longitudinal axis of the tooth member, the tooth member detachably connectable to a holder with a complementary curved surface in a receiving portion by sliding into the holder through an opening in a front of the holder extending longitudinally into the holder such that a cavity in the holder surrounds the mounting portion of the tooth member and supports the tooth member such that any movement or rotation of the tooth member other than a movement for disengagement of the tooth member is prevented when engaged.

13. A method of connecting a tooth to a holder of a tooth system for a cutter head, the method comprising;

engaging a tooth mounting portion with at least one curved surface to a holder receiving portion comprising a cavity with an opening at a front of the holder and extending longitudinally in the holder, the cavity with a complementary curved surface to the at least one curved surface, the cavity to receive the tooth mounting portion through the opening and in a sliding rotational movement into and through the cavity for engagement of the tooth member with the holder, wherein the cavity surrounds the mounting portion and supports the tooth such that any movement or rotation of the tooth other than a movement for disengagement of the tooth is prevented when the tooth is secured to the holder, wherein the at least one curved surface and the complementary curved surface contact each other at a contact area when the tooth is secured to the holder, the contact area comprising opposite curved surfaces which are parallel to each other; and, using the tooth as part of a cutter head operation.

* * * * *